United States Patent [19]

Koshiishi et al.

[11] Patent Number: 5,028,791

[45] Date of Patent: Jul. 2, 1991

[54] ELECTRON BEAM EXCITATION ION SOURCE

[75] Inventors: Akira Koshiishi, Kofu; Kohei Kawamura, Nirasaki; Masahiko Matsudo; Naoki Takayama, both of Kofu, all of Japan

[73] Assignee: Tokyo Electron Ltd., Tokyo, Japan

[21] Appl. No.: 486,256

[22] Filed: Feb. 28, 1990

Related U.S. Application Data

[63] Continuation-in-part of Ser. No. 480,765, Feb. 16, 1990.

[30] Foreign Application Priority Data

Feb. 16, 1989 [JP] Japan ..... 1-39016
Feb. 16, 1989 [JP] Japan ..... 1-39017
Feb. 28, 1989 [JP] Japan ..... 1-46888

[51] Int. Cl.[5] ..... H01J 3/04

[52] U.S. Cl. ..... 250/427; 315/111.81; 313/230; 313/362.1

[58] Field of Search ..... 250/427; 313/230, 362.1; 315/111.81

[56] References Cited

U.S. PATENT DOCUMENTS 4,468,564 8/1984 Boyer et al. ..... 250/427
4,649,278 3/1987 Chutjian et al. ..... 250/427
4,933,551 6/1990 Bernius et al. ..... 315/111.81

*Primary Examiner*—Jack I. Berman
*Attorney, Agent, or Firm*—Oblon, Spivak, McClelland, Maier & Neustadt

[57] ABSTRACT

An electron beam excitation ion source comprises a housing having an ion generation chamber therein. A discharge gas and an accelerated electrons are introduced into the ion generation chamber, causing the accelerated electrons to collide against the discharge gas to generate a plasma containing ions in the ion generation chamber. The housing includes an ion extraction port through which the ions are extracted from the ion generation chamber outside the housing and an electron reflecting member exposed in the ion generation chamber to reflect the electrons.

5 Claims, 1 Drawing Sheet

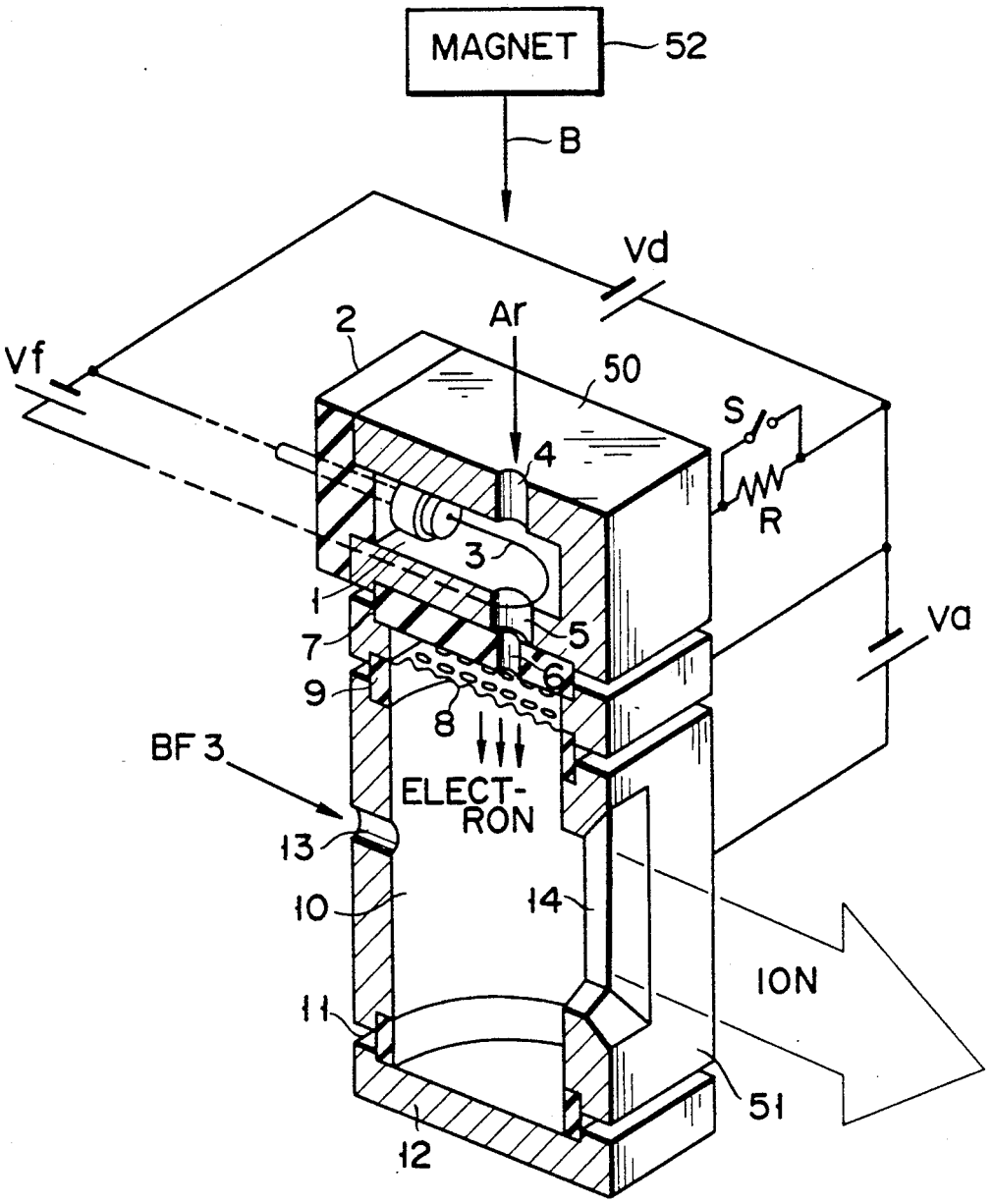
MAGNET
52
B
Vd
Ar
2
50
Vf
S
4
R
3
1
7
5
Va
9
6
8
BF 3
ELECT-
RON
13
10
14
ION
11
51
12

ELECTRON BEAM EXCITATION ION SOURCE

CROSS-REFERENCE TO THE RELATED APPLICATIONS

This application is a continuation-in-part of my copending application Ser. No. 480,769 filed Feb. 16, 1990.

BACKGROUND OF THE INVENTION

1. Field of the Invention

The present invention relates to an electron beam excitation ion source.

2. Description of the Related Art

Strong demand has arisen for developing an ion source having a large current and a long service life in, e.g., an ion-implantation apparatus utilized for manufacturing semiconductor devices.

The present applicant proposed ion beam excitation ion sources each for ionizing a source gas with an electron beam in Published Unexamined Japanese Patent Application No. 61-290629 and Japanese Patent Application No. 61-121967.

In such an electron beam excitation ion source, electrons are extracted from a plasma formed by a glow discharge and are accelerated. The accelerated electrons are guided to an ion generation chamber having a source gas atmosphere for generating a predetermined type of ions. The electrons are bombarded against source gas molecules to generate a plasma. Ions are then extracted from the plasma through an ion extraction slit formed in the ion generation chamber. This ion source has an advantage in that a high ion current density can be obtained by low ion energy.

Further demand has arisen for increasing an ion current density to shorten a processing time and increase a throughput even in the electron beam excitation ion source described above.

SUMMARY OF THE INVENTION

It is an object of the present invention to provide an electron beam excitation ion source capable of extracting ions relatively efficiently and obtaining a high ion current density to shorten a processing time and increase a throughput.

Additional objects and advantages of the invention will be set forth in the description which follows, and in part will be obvious from the description, or may be learned by practice of the invention The objects and advantages of the invention may be realized and obtained by means of the instrumentalities and combinations particularly pointed out in the appended claims.

BRIEF DESCRIPTION OF THE DRAWINGS

The accompanying drawing, which is incorporated in and constitutes a part of the specification, illustrates a presently preferred embodiment of the invention and, together with the general description given above and the detailed description of the preferred embodiment given below, serves to explain the principles of the invention.

The figure is a partially cutaway perspective view showing an electron beam excitation ion source according to an embodiment of the present invention.

DETAILED DESCRIPTION OF THE PREFERRED EMBODIMENTS

An electron beam excitation ion source according to an embodiment of the present invention will be described with reference to the accompanying drawing.

An electron generation chamber 1 is formed in a rectangular housing 50 made of a refractory conductive material such as molybdenum and having a side of, e.g., about a few centimeters. An opening is formed in one side surface of the housing 50. A plate-like insulating member 2 made of, e.g., $Si_3N_4$ or BN is formed to close this opening, so that the electron generation chamber 1 is hermetically arranged.

A U-shaped filament 3 made of tungsten or the like is mounted on the insulating member 2 so as to extend into the electron generation chamber 1 A discharge gas supply hole 4 is formed in the upper wall of the housing 50 to supply a discharge gas such as argon (Ar) gas to the electron generation chamber 1 so as to generate a plasma therein. A circular hole 5 having a diameter of, e.g., about 1 mm is formed in the lower wall of the housing 50 to extract electrons from the plasma generated in the electron generation chamber 1.

An insulating member 7 is arranged below the housing 50 to define a guide path 5 contiguous with the circular hole 6. A porous electrode 8 having a large number of pores is connected to the housing 50 through the insulating member 7. The porous electrode 8 is made of a refractory material such as tungsten. The circular hole and the path constitute an electron extraction hole 5.

The discharge gas supply hole 4 and the electron extraction hole 5 are offset from the vertical central axis of the electron generation chamber 1 toward an ion extraction slit (to be described later). The ions, therefore, can be efficiently extracted.

The filament 3 is not located on a line obtained by connecting the discharge gas supply hole 4 and the electron extraction port 5. With this arrangement, ions which flow reversely from the electron extraction port 5 can hardly reach the filament 3. Sputtering of the filament 3 by the reverse ion flow can be prevented, and its wear can be prevented accordingly.

A housing 51 is connected to the lower portion of the porous electrode 8 through an insulating member 9. The housing 51 opposes the porous electrode 8 and has a closed upper end. An ion generation chamber 10 is defined in the housing 51. The housing 51 has a box-like shape and is made of a refractory material such as molybdenum. The ion generation chamber 10 has a cylindrical internal space and has a diameter of several centimeters and a height of several centimeters. A source gas supply port 13 is formed in one side wall of the housing 51 to supply a source gas (e.g., $BF_3$) for generating a desired type of ions to the ion generation chamber 10. An ion extraction opening or slit 14 is formed in the other side wall and opposes the source gas supply port 13. A bottom plate 12 made of, e.g., a refractory material is fixed through an annular insulating member 11 on the bottom portion of the ion generation chamber 10 opposite to a porous electrode 8, to close the bottom opening of the housing. The bottom plate 12 is electrically insulated (i.e., in a floating state) from the side wall portion of the ion generation chamber 10. The inner surface of the bottom plate 12 is irradiated with electrons and is charged to reflect the electrons. Note that the bottom plate 12 may comprise an insulating member to form an electron reflection surface.

With the above-described structure, during a reaction the bottom plate reflection plate) 12 is charged negatively by radiation of electrons, thus functioning to reflect the electrons. The material of the reflection plate 12 is not limited to a conductor, and it may be formed of, for example, an insulator. Alternately a negative voltage, with respect to the cathode, may be applied to the reflection plate 12 formed of a refractory material.

In the electron beam excitation ion source having the arrangement described above, a magnetic field for vertically guiding electrons, as indicated by an arrow B, is generated by a magnetic generating means or magnet 52, and desired ions are generated.

A filament voltage Vf is applied to the filament 3 to heat it. At the same time, a discharge voltage Vd is applied across the filament 3 and the housing 50 through a resistor R or a switch S, and an acceleration voltage Va is applied across the porous electrode 8 and the housing 51. A discharge voltage Vd is applied to the electron generation chamber 1 through a resistor R. A switch S is connected in parallel to the resistor R. The switch S is turned on at the start of the operation of the apparatus, and thereafter the switch S is turned off, whereby the discharge of electrons can be quickly started.

A discharge gas such as argon gas is then supplied from the discharge gas supply hole 4 to the electron generation chamber 1 to cause the discharge voltage Vd to generate a plasma upon discharging. Electrons in this plasma are extracted into the ion generation chamber 10 by the acceleration voltage Va through the electron extraction port 5 and the porous electrode 8.

At this time, a predetermined source gas such as $BF_3$ is already supplied to the ion generation chamber 10 through the source gas supply port 13. The interior of the ion generation chamber 10 is kept in a source gas atmosphere at a predetermined pressure of, e.g., 0.001 to 0.02 Torr.

The electrons flowing in the ion generation chamber 10 are accelerated by an acceleration electric field and collide against $BF_3$ ions to generate a dense plasma. Ions are then extracted from this plasma through the ion extraction slit 14. For example, the ions are supplied to, e.g., a mass-spectroscopic magnetic field (not shown) in an ion-implantation apparatus to cause the ion-implantation apparatus to perform ion implantation.

In the electron beam excitation ion source according to this embodiment, the bottom plate 12 of the ion generation chamber 10, in which electrons are radiated to material gas to generate ions, is set in the floating state, whereby the bottom plate 12 serves as an electron reflection plate. Thus, electrons can be used effectively, while the absorption of electrons in the inner wall of the ion generation chamber 10 is suppressed. Compared to the prior art, a higher ion current density can be obtained, resulting in reduction in processing time and in an improvement of the throughput.

As has been described above, according to the electron beam excitation ion source according of this embodiment, compared to the prior art, desired ions can be generated efficiently, and a higher ion current density can be obtained, resulting in reduction in processing time and in an improvement of the throughput.

Additional advantages and modifications will readily occur to those skilled in the art. Therefore, the invention in its broader aspects is not limited to the specific details, representative device shown and described herein. Accordingly, various modifications may be made without departing from the spirit or scope of the general inventive concept as defined by the appended claims and their equivalents.

What is claimed is:

1. An electron beam excitation ion source, comprising:

a housing including an electron generation chamber, ion generation chamber, and means for communicating between said chambers;

means for generating electrons in the electron generation chamber;

a porous electrode provided in the housing;

means for supplying a source gas into the ion generation chamber;

means for biasing across the electron generation chamber and the porous electrode to accelerate the electrons in the electron generation chamber and to supply the accelerated electrons into the ion generation chamber through the communicating means and porous electrode, causing the accelerated electrons to collide against the source gas to generate a plasma containing ions in the ion generation chamber, said housing having an ion extraction port through which the ions having an energy are extracted from the ion generation chamber outside the housing; and an electron reflecting member exposed in the ion generation chamber and facing the porous electrode to reflect the ions into the plasma so that the ion current density is increased.

2. An ion source according to claim 1, wherein said housing has a side wall and an end wall electrically insulated from the side wall constituting said electron reflecting member.

3. An ion source according to claim 2, wherein said end wall is made of an insulating material or conductive material, which is charged with one part of the incident electrons so that the other parts of the incident electrons are reflected by the charged electrons.

4. An electron beam excitation ion source, comprising:

a housing including ann electron generation chamber filled with a discharge gas, an ion generation chamber, and an electron extraction hole provided between said chambers;

a filament provided in the electron generation chamber;

means for biasing the filament to generate electrons from the discharge gas in the electron generation chamber;

a porous electrode provided in the ion generation chamber and having dimensions for crossing the chamber;

means for supplying a source gas into the ion generation chamber;

means for biasing across the electron generation chamber and the porous electrode to accelerate the electrons in the electron generation chamber and to supply the accelerated electrons into the ion generation chamber through the communicating means and porous electrode, causing the accelerated electrons to collide against the source gas to generate a plasma containing ions in the ion generation chamber, said housing having an ion extraction port through which the ions having an energy are extracted from the ion generation chamber outside the housing; and an electron reflecting member exposed in the ion generation chamber and facing the porous electrode so that electrons from the porous electrode are directly incident onto the reflecting member and incident electrons are reflected toward the porous electrode thereby increasing the ion current density of the plasma generated between the porous electrode and the reflecting member.

5. An ion source according to claim 4, wherein said housing includes a discharge gas supply hole facing the electron extraction hole, and said filament is positioned to shift a line between the discharge gas supply hole and the electron extracting hole.

* * * * *